US005784897A

United States Patent [19]

Shin

[11] Patent Number: 5,784,897

[45] Date of Patent: Jul. 28, 1998

[54] EVAPORATOR OF REFRIGERATOR

[75] Inventor: Jun-Chul Shin, Incheon, Rep. of Korea

[73] Assignee: Daewoo Electronics Co., Ltd., Sepul, Rep. of Korea

[21] Appl. No.: 835,619

[22] Filed: Apr. 9, 1997

[30] Foreign Application Priority Data

Apr. 6, 1996 [KR] Rep. of Korea ..... 96-19757

[51] Int. Cl.[6] ..... F25B 39/02; E21B 33/12

[52] U.S. Cl. ..... 62/515; 165/184; 165/DIG. 525

[58] Field of Search ..... 62/515, 440, 441, 62/407, 404; 165/910, 184, DIG. 183, DIG. 528, DIG. 522, DIG. 524, DIG. 525

[56] References Cited

U.S. PATENT DOCUMENTS 3,046,758 7/1962 Heuer et al. ..... 62/515

4,269,035 5/1981 Gelbard ..... 62/155

4,589,481 5/1986 Mansson ..... 165/172

5,193,359 3/1993 Martin et al. ..... 62/515

5,255,535 10/1993 Kennedy ..... 62/515

*Primary Examiner*—William Doerrler

*Attorney, Agent, or Firm*—Jacobson, Price, Holman & Stern, PLLC

[57] ABSTRACT

An evaporator of a refrigerator provided in a cool air passage includes a serpentine heat-exchanging pipe and a heat-exchanging member wound around the pipe. The heat-exchanging member is shaped in a band having two longitudinal edges. One longitudinal edge of the heat-exchanging member is contacted with the circumference of the pipe, and the other longitudinal free edge thereof has a plurality of cut-off portions. Respective axis of each straight portion of pipe are parallel to each other and in the direction of the air flow.

3 Claims, 4 Drawing Sheets

EVAPORATOR OF REFRIGERATOR

BACKGROUND OF THE INVENTION

1. Field of the Invention

The present invention relates to an evaporator of a refrigerator. More specifically, the invention relates to an evaporator having a heat-exchanging member spirally wound around a heat-exchanging pipe.

2. Description of the Prior Art

FIG. 5 illustrates a refrigerator having a conventional evaporator. The refrigerator comprises a freezing compartment 1 and a refrigerating compartment 2 divided with a partition wall 3. In a rear wall RW of the freezing compartment 1 is provided a cool air passage 7 for receiving the cool air circulated into the compartments 1,2 through the partition wall 3. In the cool air passage 7, there is disposed an evaporator 4 for heat-exchanging with the air introduced through the passage 7. A fan 5 is disposed above the evaporator 4. That is, the fan 5 is disposed downstream in the direction of the cool air flow. Further, below the evaporator 4 there is provided a compressor 6 for compressing refrigerant which flows through the evaporator 4.

FIG. 6 shows a conventional evaporator 4. The evaporator 4 comprises a serpentine refrigerant pipe 4*a*, a pair of brackets 4*b* disposed at each end of the pipe 4*a* for maintaining a predetermined spaced interval between the straight portions 4*h* of the pipe 4*a*, and a plurality of heat-exchanging fins 4*c* formed around the outer circumference of the pipe 4*a*. The heat-exchanging fins 4*c* are disposed in the direction of the cool air flow C. A pitch of the heat-exchanging fin 4*cu* provided on the upper portion of the evaporator 4, (or the downstream air flow indicated by the direction arrow C) is larger than that of the heat-exchanging fin 4*cd* provided on the lower portion of the evaporator 4 (or the upstream air flow indicated by the direction arrow C). In other words, the pitch of the heat-exchanging fin 4*c* becomes narrower and narrower along the direction of the air flow indicated by arrow C from the top of the evaporator 4 to the bottom.

In the refrigerator, refrigerant which has attained high temperature and pressure by the compressor 6 feeds into a condenser (not shown) and further passes a capillary pipe (not shown) so that the high pressure and temperature refrigerant reverts to having low temperature one and next flows into the evaporator 4. The refrigerant passes through the refrigerant pipe 4*a* and circulates back to the compressor 6.

As the cool air circulates round the freezing compartment 1, the temperature of the air increases. The air having high temperature flows into the passage 7 through the partition wall 3. Similarly, the air which circulates round the refrigerating compartment 2 flows into the passage 7 through the partition wall 3. The relative high temperature air after having circulated round each compartment 1,2 flows toward the evaporator 4 along the direction of the air flow indicated by arrow C. The low temperature air after passing through the evaporator 4 flows to the respective compartments 1,2 by the rotation of the fan 5.

However, since the air which follows the above route passes through the space between the fins 4*c* arranged in a parallel manner along the direction of the air flow, the flow of cold air is restricted. That is, the flow of the air which passes across the lowest pipe 4*ab* is guided by the particular fin cd disposed on the pipe 4*ab* and further feeds up the corresponding particular fin 4*cb* disposed on the adjacent upper pipe 4*ac*.

Therefore, since the air having specific temperature passes through the specific area, the heat-exchanging of the pipe 4*a* of the evaporator 4 is restricted. Thus, there is a problem in that the heat-exchanging occurs unevenly over the whole surface of the evaporator 4.

SUMMARY OF THE INVENTION

Therefore, it is an object of the present invention to provide an evaporator of a refrigerator which solves the problem.

It is another object of the present invention to provide an evaporator of a refrigerator which causes the air that passes through the evaporator to become turbulent so as to heat-exchange with the evaporator evenly, thereby increasing the efficiency of a refrigerator.

To achieve the above object of the present invention, an evaporator includes a serpentine heat-exchanging pipe containing refrigerant, respective axis of each straight portion of the pipe being substantially parallel to each other and generally in the direction of air flow through a cool air passage, and a heat-exchanging member provided around a circumference of the heat-exchanging pipe in a spiral manner.

Further, the heat-exchanging member is shaped in a band.

Furthermore, the band shaped heat-exchanging member is sloped; one longitudinal edge thereof is in contact with the circumference of the heat-exchanging pipe.

Also, the other longitudinal end portion which is free from being in contact with the heat-exchanging member is directed toward the lower portion of the cool air flow.

The other longitudinal end portion which is free from being in contact with the heat-exchanging member is perpendicular to the cool air flow direction.

The other longitudinal free edge of the heat-exchanging member has a plurality of cut-off portion.

DETAILED DESCRIPTION OF THE PREFERRED EMBODIMENT

An evaporator of a refrigerator according to the present invention will be described in detail with reference to FIGS. 1–4.

Figure 5:
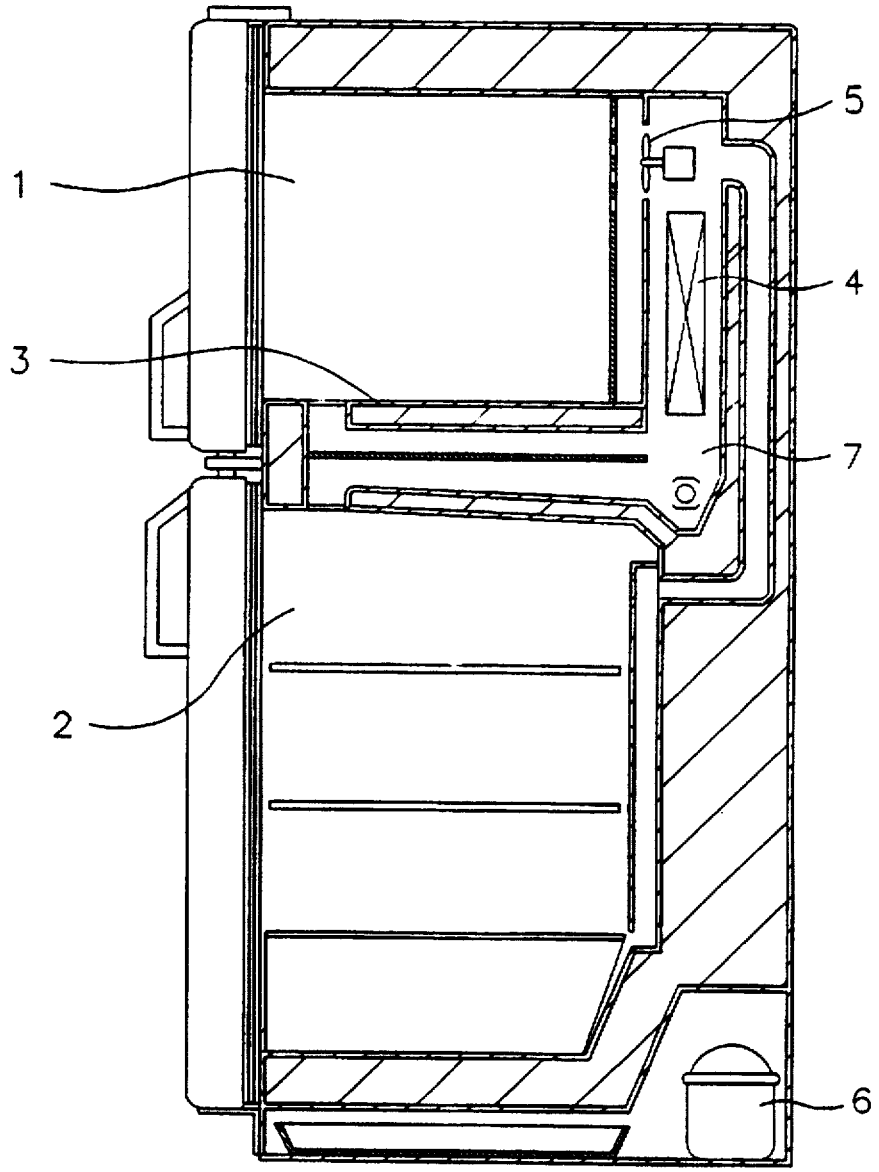
FIG.5 PRIOR ART
FIG. 5 is a vertical cross-sectional view of a refrigerator according to a prior art.
Figure 6:
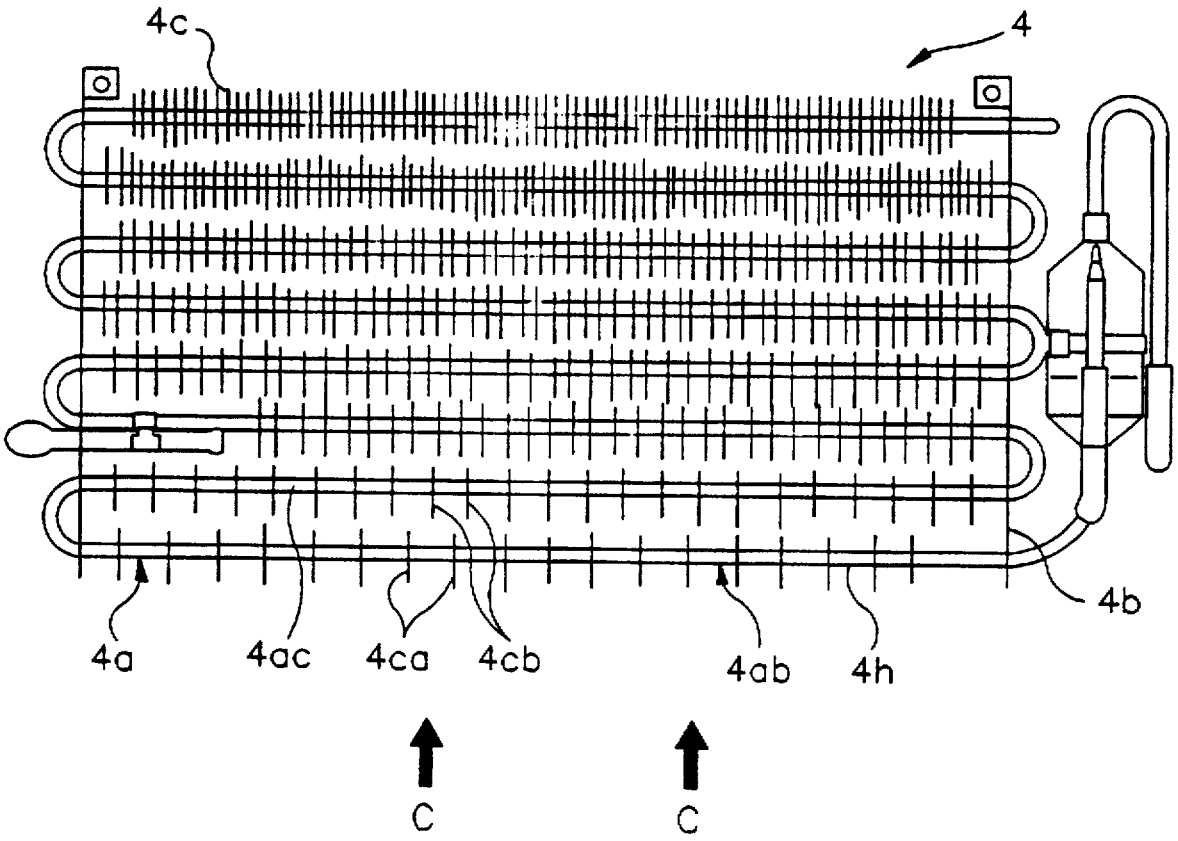
FIG.6 PRIOR ART
FIG. 6 is a front view of an evaporator of FIG. 5.

The component parts as those in the preferred embodiment are designated by the same reference numerals as the corresponding parts in the conventional embodiment of FIGS. 5 and 6, so a detailed description of those parts will be omitted.

Figure 1:
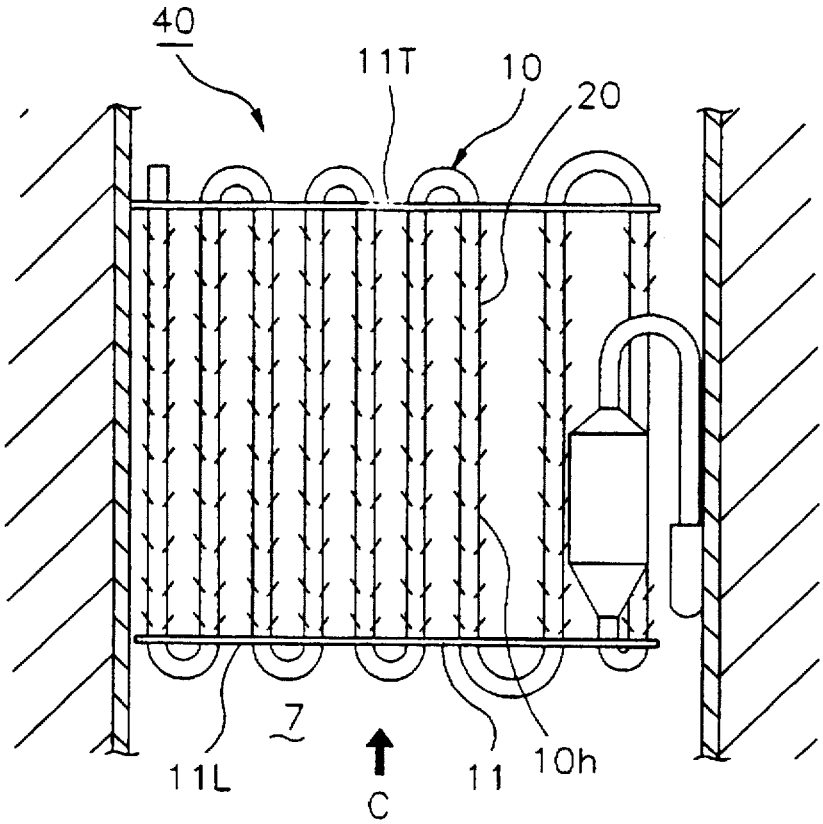
FIG. 1 is a front view of an evaporator according to the present invention.

In FIG. 1, an evaporator 40 comprises a serpentine heat-exchanging pipe 10, a pair of brackets 11T,11L disposed at each end of the pipe 10 for maintaining a predetermined spaced interval between the straight portions 10*h* of the pipe 10, and a heat-exchanging member 20 formed around the outer circumference of the pipe 10. Straight portions 1O*h* of the heat-exchanging member 10 are arranged in the direction of the cool air flow indicated by arrow C.

Figure 2:
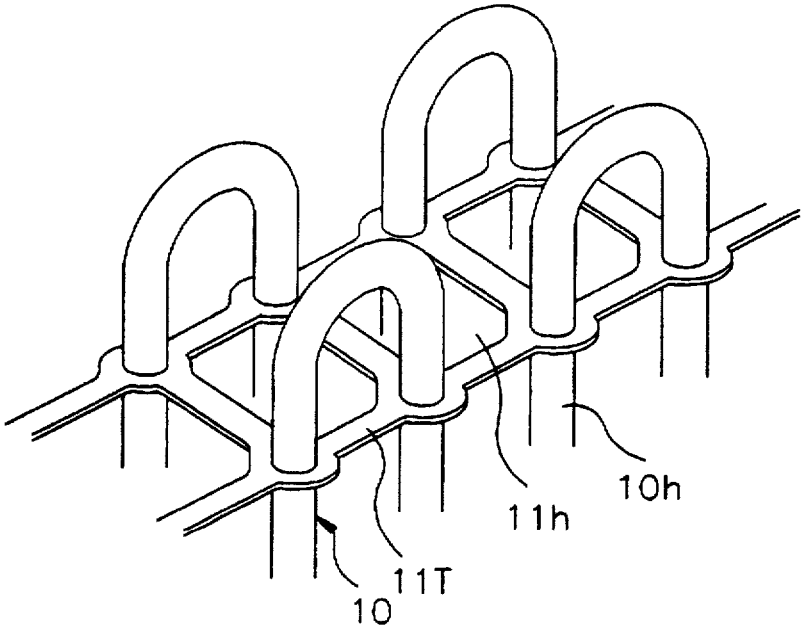
FIG. 2 is a partial perspective view of FIG. 1.

FIG. 2 shows an upper bracket 11T provided at the upper end portion of the pipe 10. The upper bracket 11T has a plurality of openings **11*h* for preventing the restriction of the cool air flow in the direction indicated by arrow C which passes through the cool air passage 7**.

Figure 3:
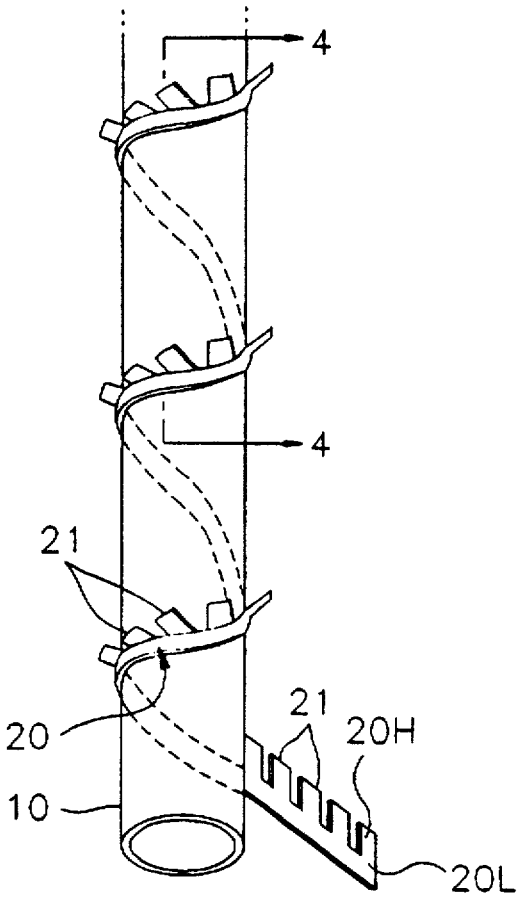
FIG. 3 is a partial perspective view of a heat-exchanging pipe having a heat-exchanging member wound around the pipe according to the present invention.
Figure 4:
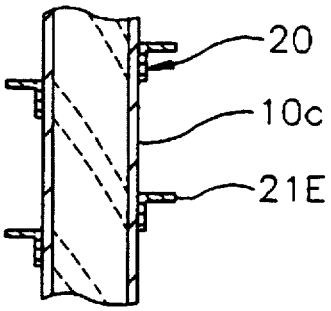
FIG. 4 is a cross-sectional view taken along line 4—4 of FIG. 3.

FIGS. 3 and 4 show the heat-exchanging member 20 provided along the outer circumference of the pipe 10. The heat exchanging member 20 is shaped in a band and is provided across a circumference of the pipe in a spiral manner. The heat-exchanging member 20 has a lower portion 20L and an upper portion 20H, in which the lower portion 20L is contacted along the circumference of the pipe 10 by the fixing means, for example brazing, while the upper portion 20H is not in contact with or free from the circumference of the pipe 10. The upper portion 20H provides a plurality of fins 21. The flat plane 21F of the fin 21 is slopingly installed on the circumference on the pipe 20. That is, each free end 21E of respective fins 21 is pointed toward the downstream direction of the air flow indicated by arrow C. On the other hand, the free end 21E of the fin 21 is traversedly installed to same direction of the air flow indicated by arrow C as shown in FIG. 4.

In the refrigerator having the above evaporator, refrigerant compressed by the compressor 6 acquires a low temperature and pressure state after passing through a condenser and a capillary tube (both of which are not shown). The refrigerant flows into the pipe 10 of the evaporator 40, an at the same time, the cool air circulated round the refrigerating compartment 2 and the freezing compartment 1 is fed into the passage 7 with the rotation of the fan 5. The incoming air contacts the pipe 10 in which the refrigerant circulates so the temperature of the air decreases. The air blows into the freezing compartment 1 and the refrigerating compartment 2.

The cool air in the passage 7 goes up toward the evaporator 40 along the air flow direction indicated by arrow C. The air which passes through the lower bracket 11L of the evaporator 40 is not interrupted owing to a plurality of openings **11*h* provided in the bracket 11L. The air which passes through the lower bracket 11L further rises toward the upper bracket 11T along the parallel portion 10*h* of the pipe 10. The stream of the rising air becomes turbulent due to the heat-exchanging member 20 which is spirally wound on the outer-surface 10C of the pipe 10. Next, the diffusion speed of the turbulent air is accelerated by the fin 21 of the heat-exchanging member 20 radially arranged on the outside-surface of the pipe 10**.

Therefore, the air which rises along the parallel portion of the specific pipe further moves diffusingly toward each of the parallel portion **10*h* of the pipes 10 which are located beside both sides of the specific pipe, respectively, with the help of the fin 21 of the heat-exchanging member 20. Therefore, the air is heat-exchanged the whole pipe 10 of the evaporator 40 and is directed toward the upper bracket 11T. The upper bracket 11T also has a plurality of openings 11*h***, which prevent any restriction of the air flow.

According to the evaporator of the present invention, since the parallel portion of the refrigerant pipe are arranged in parallel with the direction of the air flow, the air is not disrupted by the pipe, thereby promoting turbulence of the air. Moreover, since the air advances along the parallel portions of the pipe, the contacting area between the air and the pipe is increased, thereby increasing the efficiency of the heat-exchange. Moreover, a plurality of fins are provided around the heat-exchanging member to prevent the restricted heat-exchange which arises by the specific cool air flow within the specific portion. Therefore, the heat-exchange evenly arises over the whole surface of the evaporator, thereby increasing the efficiency of the heat-exchange.

What is claimed is:

1. In an evaporator of a refrigerator provided in a cool air passage for heat-exchanging the cool air circulated in a refrigerating compartment and a freezing compartment, said evaporator comprising a serpentine heat-exchanging pipe containing refrigerant, respective axis of each straight portion of said pipe being substantially parallel to each other and generally in the direction of air flow through said cool air passage; and a heat-exchanging member provided around a circumference of said heat-exchanging pipe in a spiral manner, wherein said heat-exchanging member is shaped as a band having two longitudinal end portions, one longitudinal end portion of said band-shaped heat-exchanging member is in contact along the circumference of said heat-exchanging pipe and the other longitudinal end portion of said band-shaped heat-exchanging member which is free from being in contact with said heat-exchanging pipe is sloped upstream in the direction of the cool air flow.

2. An evaporator of a refrigerator as set forth in claim 1, wherein the other longitudinal end portion of said heat-exchanging member which is free from being in contact with said heat-exchanging pipe has a plurality of cut-off portions for causing the laminar air flow to become turbulent.

3. In an evaporator of a refrigerator provided in a cool air passage for heat-exchanging the cool air circulated in a refrigerating compartment and a freezing compartment, said evaporator comprising a serpentine heat-exchanging pipe containing refrigerant, the respective axis of each straight portion of said pipe being substantially parallel to each other and generally in the direction of air flow through said cold air passage; and a heat-exchanging member provided around a circumference of said heat-exchanging pipe in a spiral manner, wherein said heat-exchanging member is shaped as a band having two longitudinal end portions, one longitudinal end portion of said band-shaped heat-exchanging member is in contact along the circumference of said heat-exchanging pipe wherein the other longitudinal end portion of said heat-exchanging member which is free from being in contact with said heat-exchanging pipe is perpendicular to the direction of cool air flow.

* * * * *